US008357650B2

(12) United States Patent
Somerville Roberts et al.

(10) Patent No.: US 8,357,650 B2
(45) Date of Patent: Jan. 22, 2013

(54) AMINOCARBOXYLIC BUILDER PARTICLE

(75) Inventors: Nigel Patrick Somerville Roberts, Newcastle upon Tyne (GB); Chris Hughes, Essex (GB); Robert Ian Dyson, West Yorkshire (GB)

(73) Assignee: The Procter & Gamble Company, Cincinnati, OH (US)

( * ) Notice: Subject to any disclaimer, the term of this patent is extended or adjusted under 35 U.S.C. 154(b) by 37 days.

(21) Appl. No.: 13/088,449

(22) Filed: Apr. 18, 2011

(65) Prior Publication Data

US 2011/0263473 A1 Oct. 27, 2011

(30) Foreign Application Priority Data

Apr. 23, 2010 (EP) ..... 10160963

(51) Int. Cl.
*C11D 3/30* (2006.01)

(52) U.S. Cl. ..... 510/480; 510/276; 510/349; 510/445; 510/438; 510/441; 510/443; 510/444; 510/477; 510/531

(58) Field of Classification Search ..... 510/276, 510/349, 445, 438, 441, 443, 444, 480, 477, 510/531

See application file for complete search history.

(56) References Cited

U.S. PATENT DOCUMENTS

| | | | | |
|---|---|---|---|---|
| 3,332,876 | A | 7/1967 | Walker | |
| 3,714,050 | A * | 1/1973 | Gray | 510/283 |
| 3,880,765 | A | 4/1975 | Watson | |
| 4,246,612 | A | 1/1981 | Berry et al. | |
| 4,536,317 | A | 8/1985 | Llenado et al. | |
| 4,637,891 | A * | 1/1987 | Delwel et al. | 510/349 |
| 4,645,616 | A * | 2/1987 | Niven et al. | 510/452 |
| 4,760,025 | A | 7/1988 | Estell et al. | |
| 4,810,410 | A | 3/1989 | Diakun et al. | |
| 5,114,611 | A | 5/1992 | Van Kralingen et al. | |
| 5,180,515 | A * | 1/1993 | Boucher et al. | 510/359 |
| 5,277,084 | A | 1/1994 | Weber et al. | |
| 5,288,627 | A | 2/1994 | Nielsen | |
| 5,679,630 | A | 10/1997 | Baeck et al. | |
| 5,695,679 | A | 12/1997 | Christie et al. | |
| 5,763,385 | A | 6/1998 | Bott et al. | |
| 5,780,419 | A | 7/1998 | Doumen et al. | |
| 5,786,313 | A | 7/1998 | Schneider et al. | |
| 5,824,532 | A | 10/1998 | Barnett et al. | |
| 5,856,164 | A | 1/1999 | Outtrup et al. | |
| 5,948,748 | A | 9/1999 | Hagino et al. | |
| 5,958,866 | A | 9/1999 | Donoghue et al. | |
| 5,989,169 | A | 11/1999 | Svendsen et al. | |
| 6,093,562 | A | 7/2000 | Bisgård-Frantzen et al. | |
| 6,162,259 | A | 12/2000 | Williams | |
| 6,165,970 | A * | 12/2000 | Williams et al. | 510/480 |
| 6,187,576 | B1 | 2/2001 | Svendsen et al. | |
| 6,204,232 | B1 | 3/2001 | Borchert et al. | |
| 6,225,278 | B1 * | 5/2001 | Detering et al. | 510/480 |
| 6,265,371 | B1 | 7/2001 | Hagino et al. | |
| 6,312,936 | B1 | 11/2001 | Poulose et al. | |
| 6,403,355 | B1 | 6/2002 | Hagihara et al. | |
| 6,451,224 | B1 | 9/2002 | Wilson | |
| 6,583,098 | B1 * | 6/2003 | Cassie | 510/376 |
| 6,605,458 | B1 | 8/2003 | Hansen et al. | |
| 6,638,748 | B2 | 10/2003 | Hatada et al. | |
| 6,777,530 | B1 * | 8/2004 | Meixner et al. | 528/422 |
| 6,833,346 | B1 * | 12/2004 | Morrison et al. | 510/444 |
| 7,091,168 | B2 | 8/2006 | Weuthen et al. | |
| 7,141,403 | B2 | 11/2006 | Outtrup et al. | |
| 7,262,042 | B2 | 8/2007 | Weber et al. | |
| 7,985,569 | B2 | 7/2011 | Aehle et al. | |
| 2005/0049164 | A1 * | 3/2005 | Sommerville-Roberts et al. | 510/293 |
| 2006/0183659 | A1 | 8/2006 | Dovey et al. | |
| 2008/0045430 | A1 | 2/2008 | Witteler et al. | |
| 2008/0090747 | A1 | 4/2008 | Augustinus et al. | |
| 2008/0193999 | A1 | 8/2008 | Andersen et al. | |
| 2008/0293610 | A1 | 11/2008 | Shaw et al. | |
| 2009/0075855 | A1 | 3/2009 | Gibis et al. | |
| 2010/0016203 | A1 | 1/2010 | Warkotsch et al. | |
| 2010/0137649 | A1 * | 6/2010 | Scheibel et al. | 568/448 |
| 2010/0154832 | A1 | 6/2010 | Zipfel et al. | |
| 2010/0160204 | A1 | 6/2010 | Zipfel et al. | |
| 2010/0197546 | A1 | 8/2010 | Geret et al. | |
| 2011/0053819 | A1 | 3/2011 | Preuschen et al. | |
| 2011/0064646 | A1 | 3/2011 | Spephansen | |
| 2011/0124545 | A1 * | 5/2011 | Mort et al. | 510/220 |
| 2011/0241235 | A1 * | 10/2011 | Murkunde et al. | 264/5 |

FOREIGN PATENT DOCUMENTS

| | | | |
|---|---|---|---|
| EP | 1721962 | A1 | 11/2006 |
| GB | 1408970 | A | 12/1975 |
| WO | WO 93/02168 | A1 | 2/1993 |
| WO | WO 94/02597 | A1 | 2/1994 |
| WO | WO 97/32954 | | 9/1997 |
| WO | WO 98/01521 | A1 | 1/1998 |
| WO | WO 2008/074667 | A1 | 6/2008 |
| WO | WO 2009/006521 | A2 | 1/2009 |
| WO | WO 2009/021867 | A2 | 2/2009 |
| WO | WO 2009/092699 | | 7/2009 |

OTHER PUBLICATIONS

U.S. Appl. No. 13/088,446, filed Apr. 18, 2011, Somerville Roberts, et al.

U.S. Appl. No. 13/088,451, filed Apr. 18, 2011, Somerville Roberts, et al.

Needleman, S. B. and Wunsch, C. D. (1970) J. Mol. Biol. 48, 443-453.

International Search Report, 5 Pages, Apr. 2011.

* cited by examiner

*Primary Examiner* — Charles Boyer

(74) *Attorney, Agent, or Firm* — Tiffany M. Zerby; Steven W. Miller

(57) ABSTRACT

A particle comprising an aminocarboxylic builder and sulphate or citrate wherein the aminocarboxylic builder and the sulphate or citrate are present in a weight ratio of from about 6:1 to about 1:1.

7 Claims, No Drawings

AMINOCARBOXYLIC BUILDER PARTICLE

TECHNICAL FIELD

The present invention is in the field of biodegradable builders. In particular it relates to a particle comprising an aminocarboxylic builder. The particle is very stable to high ambient humidity during transport, storage, handling and even when it is present in a detergent composition.

BACKGROUND OF THE INVENTION

Traditionally phosphate builders have been used in detergent formulations. Environmental considerations make desirable the replacement of phosphate by more environmentally friendly builders. Apart from cleaning repercussions, the replacement of phosphate can impair the stability of the detergent. Phosphate is a good moisture sink contributing to moisture management and stability of the detergent. The majority of the builders which can be used as replacement for phosphate are incapable of acting as moisture sinks—furthermore they are usually hygroscopic, contributing to the instability and degradation of the detergent. This has a greater impact in detergents which comprise moisture sensitive ingredients such as bleach and enzymes.

A consequent problem found with many phosphate replacements, such as aminocarboxylic builders, is their instability and difficulty in handling under the high ambient temperature and humidity conditions that can be found in manufacturing plants or during transport and storage. This problem can be particularly acute during summer months or during a rainy season. Particulate materials can lose their flowability and—in cases in which the materials are highly hygroscopic—they can become sticky, crusty or turn into liquids, making them unsuitable for use in detergent formulations.

Aminocarboxylic compounds such as methylglycine diacetic acid and salts thereof are suitable compounds as phosphate replacement in detergent compositions. The use thereof is, however, in most cases restricted to their use in liquid applications. This is due to the fact that these materials in solid form tend to be highly hygroscopic. Hence in typical manufacturing conditions, storage and/or transport, they can lose their stability and even return to its liquid form. It is possible to avoid many of these issues by the use of protective engineering measures such as dehumidification of the ambient air. However these can be very expensive to implement—especially in large manufacturing plants.

There have been several attempts to convert methylglycine diacetic acid and salts thereof into solid particles. Some of the processes involved are quite cumbersome and sometimes the resulting particles are not totally satisfactory from a handling, transport, storage and in-product stability viewpoint. Other drawbacks found with some of the particles disclosed in the literature is that the particles include additional materials that can be inert in terms of cleaning, thereby contributing to the cost of the product without providing any benefits and in some cases even having negative impact on cleaning, such as leaving residues on the cleaned items.

Turning to the existing art, US 2008/0045430 discloses a mixed powder or mixed granule containing at least 80% by weight of a mixture of (a) from 5 to 95% by weight of at least one glycine-N,N-diacetic acid derivative of general formula MOOC—CHR—N($CH_2$COOM)$_2$ where R is C1-12 alkyl and M is alkali metal, (b) from 5 to 95% by weight of at least one polyethylene glycol or of at least one nonionic surfactant or of a mixture thereof or of a polymer selected from the group consisting of polyvinyl alcohols, polyvinylpyrrolidones (PVP), polyalkylene glycols and derivatives thereof. The particles of '430 comprise materials that may not contribute to cleaning and can leave residues on the cleaned items. Moreover, the dissolution of the particles seems to rely on the melting or dissolution of component b). The current tendency on automatic cleaning processes, such as laundry and dishwashing, is to use lower temperatures. There is a risk that the particles would not dissolve sufficiently rapidly at low temperature. Although, the particles have improved handleability there is still room to improve their physical properties especially in conditions of high ambient humidity.

WO2009/092699 discloses a process for the preparation of free flowing MGDA granules having low hygroscopicity. This comprises heating a concentrated slurry comprising MGDA and spray granulating said slurry. The process requires the preparation of the concentrated slurry before processing further and this could be difficult depending on the solids concentration used. The process is also limited by the requirement that the drying air used in the spray-granulation has to be less than 120° C. This means that drying rates will be limited compared to processes using higher drying air temperatures.

The objective of the present invention is to provide a particle which maintains its physical structure and it is stable during storage, transport, manufacture and at the same time it is stable in detergent compositions.

SUMMARY OF THE INVENTION

According to a first aspect of the invention, there is provided a particle comprising an aminocarboxylic builder. The term "particle" as used herein includes a single particle and a plurality of particles. For the purpose of the present invention the term "aminocarboxylic builder" includes aminocarboxylic acids, salts and derivatives thereof. Preferably the aminocarboxylic builder is an aminopolycarboxylic builder, more preferably a glycine-N,N-diacetic acid or derivative of general formula MOOC—CHR—N($CH_2$COOM)$_2$ where R is C1-12 alkyl and M is alkali metal. Especially preferred aminocarboxylic builder for use herein is methylglycine diacetic acid, more preferably alkali metal salts, even more preferably sodium, potassium and mixed sodium/potassium salts. Especially preferred for use herein is the tri-sodium salt. The aminocarboxylic builder and the sulphate or citrate (or mixtures thereof) are present in the particle in a weight ratio of from about 6:1 to about 2:1, preferably from about 5:1 to about 3:1

The ratio of the aminocarboxylic builder and sulphate or citrate is critical in order to obtain a moisture resistant and physically robust particle. Particles with aminocarboxylic builder:sulphate or citrate weight ratios outside those described herein before give rise to particles with poor storage characteristics.

In a preferred embodiment, the particle of the invention has a pH in 1% wt aqueous solution at 20° C. of less than 10, more preferably from about 4 to about 10, even more preferably from about 5 to about 9 and especially from about 6 to about 8. Particles with pH of less than 10 are more stable than particles with a higher pH. Additionally, the particles are suitable for use in detergent compositions that usually are alkaline.

In a preferred embodiment, the particle is highly active, this makes it space efficient for its use in detergents. Preferably the particle comprises more than about 40%, more preferably more than about 60% and especially more than 70% by weight of the particle of the amininocarboxylic builder.

Preferred sulphate for use herein is sodium sulphate. Particles containing sodium sulphate present a really good stability profile.

In a preferred embodiment the particle of the invention has a bulk density of at least 650 g/l, this makes the particle space efficient and help to avoid segregation in detergent compositions.

Preferably the particle of the invention has a weight geometric mean particle size of from about 400 μm to about 1200 μm, more preferably from about 500 μm to about 1000 μm and especially from about 700 μm to about 900 μm. Preferably the particle has a low level of fines and coarse particles, in particular less than 10% by weight of the particle are above about 1400, more preferably about 1200 and/or below about 400, more preferably about 200 μm. These mean particle size and particle size distribution further contribute to the stability of the particle. In especially preferred embodiments, from the stability point of view, the particle has a weight geometric mean particle size of from about 700 to about 1000 μm with less than about 3% by weight of the bleach above about 1180 μm and less than about 5% by weight of the bleach below about 200 μm. The weight geometric mean particle size can be measured using a. Malvern particle size analyzer based on laser diffraction.

According to a second aspect of the invention, there is provided a process for making the particle of the invention. The process comprises the steps of:

a) providing a solution containing an aminocarboxylic builder;
b) optionally adding an acidifying agent;
c) adding sulphate or citrate to the solution resulting from of step b) to form a mixture; and
d) converting the mixture resulting from step c) into particles.

DETAILED DESCRIPTION OF THE INVENTION

The present invention envisages a particle comprising an aminocarboxylic builder and sulphate or citrate (preferably sulphate). The particle has good stability during storage, transport, manufacture and even in stressed detergent matrixes such as phosphate free detergents. There is also provided a process for making the particle. The process not only produces a very robust particle in term of physical and chemical stability but the particle is also very robust in terms of processability. It has been surprisingly found that even when processing at high temperatures the particle has a reduced tendency to become sticky.

Aminocarboxylic Builder

Preferably the aminocarboxylic builder of the particle of the invention is an aminopolycarboxylic builder, more preferably a glycine-N,N-diacetic acid or derivative of general formula MOOC—CHR—N($CH_2COOM)_2$ where R is C1-12 alkyl and M is alkali metal. Especially preferred aminocarboxylic builder for use herein is methylglycine diacetic acid, more preferably alkali metal salts thereof, even more preferably sodium, potassium and mixed sodium/potassium salts. Especially preferred for use herein is the tri-sodium salt.

Preferred aminocarboxylic builders include MGDA (methyl-glycine-diacetic acid), GLDA (glutamic-N,N-diacetic acid), iminodisuccinic acid (IDS), carboxymethyl inulin and salts and derivatives thereof. MGDA (salts and derivatives thereof) is especially preferred according to the invention, with the tri-sodium salt thereof being preferred and a sodium/potassium salt being specially preferred for the low hygroscopicity and fast dissolution properties of the resulting particle.

Other suitable aminocarboxylic builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), IDS (iminodiacetic acid) and salts and derivatives thereof such as N-methyliminodiacetic acid (MIDA), alpha-alanine-N,N-diacetic acid (alpha-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N,N-diacetic acid (TUDA) and sulfomethyl-N,N-diacetic acid (SMDA) and alkali metal salts and derivative thereof.

Preferably, the particle of the invention is made by a process that involves the step of spray-drying the mixture containing the aminocarboxylic builder, the sulphate and optionally the acidifying agent to form a spray-dried powder.

Preferred for use herein is sulphate, in particular sodium sulphate. Preferably a saturated solution is used herein. It has been found extremely useful to use a saturated sulphate solution at 25° C. (i.e. a solution comprising approximately 25% by weight of the solution of sodium sulphate). This is optimum from a particle formation viewpoint because it simplifies manufacture of the particle.

Acidifying Agent

Any acid can be used as acidifying agent, including organic acids and mineral acids. Organic acids can have one or two carboxyls and preferably up to 15 carbons, especially up to 10 carbons, such as formic, acetic, propionic, capric, oxalic, succinic, adipic, maleic, fumaric, sebacic, malic, lactic, glycolic, tartaric and glyoxylic acids. Mineral acids include hydrochloric and sulphuric acid. Sulphuric acid is especially preferred for use herein because it forms sodium sulphate on neutralisation. Also sulphuric acid can be added as the concentrated form and hence minimise the amount of additional water that would need to be dried off.

Process for Making the Particle of the Invention

The particle of the invention is obtainable, preferably obtained, by a process comprising the steps of:

a) providing a solution comprising the aminocarboxylic builder. The solution is preferably aqueous and comprises at least 5% of the builder, preferably between 20 and 42%, more preferably between 25 and 40% by weight of the solution of builder. Preferably the builder is methylglycine diacetic acid (MGDA). The aminocarboxylic builder can be in acid form or in the form of a salt or derivative thereof. Aminocarboxylic builders in acid form give rise to particle with very good moisture stability profile. Aminocarboxylic builders in the form of a salt give rise to particles suitable for use in alkaline detergents. Especially preferred for used herein is the tri-sodium salt.
b) If the aminocarboxylic builder is in the form of a salt mixed with an alkaline material such as sodium hydroxide, it is preferred to add an acidifying agent (step b)) to the solution. The acidifying agent is preferably a mineral acid and more preferably sulphuric acid. Sulphuric acid has been found to further contribute to the stability of the final particle due to the formation of a sulphate salt from the neutralisation reaction. This effect can be used to increase the robustness of the final aminocarboxylic particle. Preferably the final pH of the solution is from about 2 to about 10, more preferably from about 4 to about 9 and especially from about 5 to about 8 as measured at a temperature of 20° C.

c) After the solution has reached the target pH, sulphate or citrate is added to the solution. The sulphate or citrate contributes to the precipitation and crystallization of the aminocarboxylic salt or acid during processing. The aminocarboxylic salt or acid and the sulphate or citrate interact in such a way that the resulting mixture gives rise to a particle with very good physical properties, including low hygroscopicity. It is known that the process influences the physical properties of the resulting particle. In preferred embodiments the sulphate or citrate is in the form of a saturated solution or in the form of micronized particles. The former has the advantage of maximising the contact between the aminocarboxylic acid or salt and the sulphate or citrate. In the case of the latter, the use of micronized particles helps maximise the possible contact between the solid sulphate or citrate and aminocarboxylic acid and/or salt solution by increasing the solid surface area in contact with the aminocarboxylic acid/salt. This can be beneficial if water levels need to be minimised. An alternative approach is to add additional alkaline material to the solution of aminocarboxylic acid/salt and then add sufficient mineral acid, preferably sulphuric acid, to generate sulphate in-situ. In especially preferred embodiments the sulphate is sodium sulphate.

d) Lately, the resulting mixture from step c) is converted into particles by driving away the water. The water is driven away by any know technique, such as drying, evaporation, etc.

The particle obtainable and preferably obtained according the above process presents very good stability properties and robustness during handling, manufacture, storage, transport and when they form part of detergent compositions, even in stressed detergent matrixes such as those found in phosphate free products.

The first step (step a)) for the preparation of the particle of the invention requires to provide a solution comprising the aminocarboxylic builder, preferably MGDA. The aminocarboxylic builder can be in acid form or in the form of a salt or derivative thereof. If the aminocarboxylic builder is in salt form having a pH above 8 an acidifying agent, preferably sulphuric acid, is added (step b)) to form a mixture with a pH of less than 7. Preferably, step a) and b) take place at ambient temperature.

The third step of the process (step c)) requires adding sulphate or citrate to the solution resulting from step a) or b) to form a mixture. The mixture can be formed in any known mixing equipment. Preferred for use herein is a crutcher mixer. Typically, the residence time of the mixture in the mixer is in the range of from 2 minutes to 45 minutes. The mixer typically has a motor size such that its installed power is in the range of from 50 kW to 100 kW.

The mixture can then be transferred from the mixer preferably through at least one pump to the drying equipment. Any equipment capable of drying the mixture can be used, for example a fluidised bed, a spray-drying tower, etc. If the mixture is going to be sprayed dried then the mixture is pumped to a spray nozzle. The mixture is then sprayed through the spray nozzle into a spray-drying tower. Typically, a plurality of nozzles are used in the process, preferably the nozzles are positioned in a circumferential manner at different heights throughout the spray-drying tower. The nozzles are preferably positioned in a counter-current manner with respect to the air flow in the tower. The air temperature should be above 140° C., preferably above 180° C., more preferably above 200° C. and especially above 240° C. As stated before the particle of the invention does not become sticky or gives rise to hot spots in the equipment even when processed at high temperature (i.e. above 200° C.). The use of high temperatures allows one to reduce the residence time of the material in the spray-drying tower and seems to contribute to the robustness of the resulting particle.

The spray-dried powder typically has a moisture content of about 5 wt %. Once the powder is obtained, it can be processed further to modify its granulometry and density. More dense particles have been found to be more robust and stable. The powder can be subjected to any compacting operation. Preferred for use herein is roller compaction. The compacting step can be followed by a grinding step with recycle to achieve a specific granulometry.

The particle can be dusted in order to further improve its flowability and stability. Preferably the dusting material has a weight geometric mean particle size of from less than about 1 to about 100 μm, more preferably from less than about 2 to about 50 μm. The dusting material particle size can for example be measured according to ASTM c 690-1992. This particle size also contributes towards the stability of the aminocarboxylic builder particle.

Additional benefits can be achieved when the aminocarboxylic builder particle has a relatively large weight geometric mean particle size and narrow particle size distribution and the dusting material has a small mean particle size. Particularly good combinations are those in which the particle of the invention has a weight geometric mean particle size of from about 700 to about 1000 μm with less than about 3% by weight of the polymer above about 1180 μm and less than about 5% by weight of the polymer below about 200 μm and the dusting material has a weight geometric mean particle size of from less than about 10 to about 40 μm. This is favourable not only from the stability point of view but it also allows to minimise the amount of dusting material needed.

In preferred embodiments the particle and the dusting material are mixed in a weight ratio of from about 90:1 to about 10:1, more preferably from about 60:1 to about 30:1. It is surprising that such small amount of dusting material had such an impact on the stability of the particle.

Suitable dusting materials include carbonate, sulphate, talc and silica. Especially preferred for use herein is a hydrophobic silica. Such materials are extremely fine-particle size silicon dioxides, the surfaces of which have been chemically modified to make them predominantly hydrophobic. Amorphous synthetic silica can be manufactured using a thermal or pyrogenic or a wet process. The thermal process leads to fumed silica, the wet process to either precipitated silica o silica gels. The silica can be rendered hydrophobic by for example, surface treatment using one or more organosilicon compounds to produce, on the silicon dioxide surface, silicone groups. Individual particles have a diameter typically ranging from less than about 0.01 μm to about 100 μm, preferably less than about 10 μm to about 40 μm and a weight geometric mean particle size (as measured using a Multisizer 100 μm following ASTM C 690-1992) of from less than about 0.1 μm to about 40 μm, preferably from less than about 1 μm to 20 μm.

Hydrophobic silica materials useful herein are commercially available from Degussa Corporation under the names Aerosil® and Sipernat®. These materials are described in Degussa Technical Bulletin Pigments No. 11, issued October 1982, No. 6, issued August 1986, and No. 32, issued April 1980, and a bulletin entitled Precipitated Silicas and Silicates, issued July 1984, all incorporated herein by reference. Examples of suitable materials include Sipernat® D10, D11 and D17, Quso® WR55 and WR83, and Aerosil® R972, R974, R805, and R202. Preferred materials are Aerosil® R972 and Sipernat® D10, which is particularly preferred.

The particle of the invention can be dusted with a dusting agent in a level of from about 0.001 to 10%, preferably from about 0.05 to 5%, more preferably from about 0.1 to 2%, and especially from about 0.3 to 1% by weight of the particle. Preferably the dusting agent is a hydrophobic silica.

Automatic Dishwashing Detergent Composition

The detergent composition can comprises in addition to the particle of the invention one or more detergent active components which may be selected from surfactants, enzymes, bleach, bleach activator, bleach catalyst, polymers, dying aids and metal care agents.

Surfactant

Surfactants suitable for use herein include non-ionic surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R1O[CH2CH(CH3)O]_x[CH2CH2O]_y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH)R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Amine oxides surfactants useful herein include linear and branched compounds having the formula:

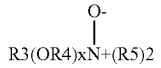

wherein R3 is selected from an alkyl, hydroxyalkyl, acylamidopropoyl and alkyl phenyl group, or mixtures thereof, containing from 8 to 26 carbon atoms, preferably 8 to 18 carbon atoms; R4 is an alkylene or hydroxyalkylene group containing from 2 to 3 carbon atoms, preferably 2 carbon atoms, or mixtures thereof; x is from 0 to 5, preferably from 0 to 3; and each R5 is an alkyl or hydroxyalkyl group containing from 1 to 3, preferably from 1 to 2 carbon atoms, or a polyethylene oxide group containing from 1 to 3, preferable 1, ethylene oxide groups. The R5 groups can be attached to each other, e.g., through an oxygen or nitrogen atom, to form a ring structure.

These amine oxide surfactants in particular include C10-C18 alkyl dimethyl amine oxides and C8-C18 alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are C10-C18 alkyl dimethylamine oxide, and C 10-18 acylamido alkyl dimethylamine oxide.

Surfactants may be present in amounts from 0 to 10% by weight, preferably from 0.1% to 10%, and most preferably from 0.25% to 6% by weight of the total composition.

Builder

Builders for use herein include phosphate builders and non-phosphate builders, preferably the builder is a non-phosphate builder. If present, builders are used in a level of from 5 to 60%, preferably from 10 to 50% by weight of the composition. In some embodiments the product comprises a mixture of phosphate and non-phosphate builders.

Phosphate Builders

Preferred phosphate builders include mono-phosphates, di-phosphates, tri-polyphosphates or oligomeric-polyphosphates. The alkali metal salts of these compounds are preferred, in particular the sodium salts. An especially preferred builder is sodium tripolyphosphate (STPP).

Non-Phosphate Builders

In addition to the aminocarboxylic builders in the particle of the invention, the composition can comprise carbonate and/or citrate.

The particle of the invention is present in the composition in an amount of at least 1%, more preferably at least 5%, even more preferably at least 10%, and most especially at least 20% by weight of the total composition.

Preferably builders are present in an amount of up to 50%, more preferably up to 45%, even more preferably up to 40%, and especially up to 35% by weight of the composition. In preferred embodiments the composition contains 20% by weight of the composition or less of phosphate builders, more preferably 10% by weight of the composition or less, most preferably they are substantially free of phosphate builders.

Other non-phosphate builders include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethyl enedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Other suitable builders are disclosed in WO 95/01416, to the contents of which express reference is hereby made.

Polymer

The polymer, if present, is used in any suitable amount from about 0.1% to about 50%, preferably from 0.5% to about 20%, more preferably from 1% to 10% by weight of the composition. Sulfonated/carboxylated polymers are particularly suitable for the composition of the invention.

Suitable sulfonated/carboxylated polymers described herein may have a weight average molecular weight of less than or equal to about 100,000 Da, or less than or equal to about 75,000 Da, or less than or equal to about 50,000 Da, or from about 3,000 Da to about 50,000, preferably from about 5,000 Da to about 45,000 Da.

As noted herein, the sulfonated/carboxylated polymers may comprise (a) at least one structural unit derived from at least one carboxylic acid monomer having the general formula (I):

(I)

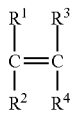

wherein $R^1$ to $R^4$ are independently hydrogen, methyl, carboxylic acid group or $CH_2COOH$ and wherein the carboxylic acid groups can be neutralized; (b) optionally, one or more structural units derived from at least one nonionic monomer having the general formula (II):

(II)

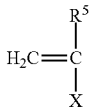

wherein $R^5$ is hydrogen, $C_1$ to $C_6$ alkyl, or $C_1$ to $C_6$ hydroxyalkyl, and X is either aromatic (with $R^5$ being hydrogen or methyl when X is aromatic) or X is of the general formula (III):

(III)

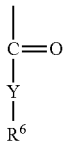

wherein $R^6$ is (independently of $R^5$) hydrogen, $C_1$ to $C_6$ alkyl, or $C_1$ to $C_6$ hydroxyalkyl, and Y is O or N; and at least one structural unit derived from at least one sulfonic acid monomer having the general formula (IV):

(IV)

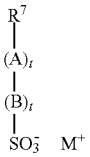

wherein R7 is a group comprising at least one sp2 bond, A is O, N, P, S or an amido or ester linkage, B is a mono- or polycyclic aromatic group or an aliphatic group, each t is independently 0 or 1, and M+ is a cation. In one aspect, R7 is a C2 to C6 alkene. In another aspect, R7 is ethene, butene or propene.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth)allyl sulfonate, vinyl sulfonate, sodium phenyl (meth)allyl ether sulfonate, or 2-acrylamido-methyl propane sulfonic acid. Preferred non-ionic monomers include one or more of the following: methyl (meth)acrylate, ethyl (meth) acrylate, t-butyl (meth)acrylate, methyl (meth)acrylamide, ethyl (meth)acrylamide, t-butyl (meth) crylamide, styrene, or α-methyl styrene.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

The carboxylic acid is preferably (meth)acrylic acid. The sulfonic acid monomer is preferably one of the following: 2-acrylamido methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, allyloxybenzenesulfonic acid, methallyloxybenzensulfonic acid, 2-hydroxy-3-(2-propenyloxy)propanesulfonic acid, 2-methyl-2-propene-1-sulfonic acid, styrene sulfonic acid, vinylsulfonic acid, 3-sulfopropyl acrylate, 3-sulfopropyl methacrylate, sulfomethylacrylamid, sulfomethylmethacrylamide, and water soluble salts thereof. The unsaturated sulfonic acid monomer is most preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Other suitable organic polymer for use herein includes a polymer comprising an acrylic acid backbone and alkoxylated side chains, said polymer having a molecular weight of from about 2,000 to about 20,000, and said polymer having from about 20 wt % to about 50 wt % of an alkylene oxide. The polymer should have a molecular weight of from about 2,000 to about 20,000, or from about 3,000 to about 15,000, or from about 5,000 to about 13,000. The alkylene oxide (AO) component of the polymer is generally propylene oxide (PO) or ethylene oxide (EO) and generally comprises from about 20 wt % to about 50 wt %, or from about 30 wt % to about 45 wt %, or from about 30 wt % to about 40 wt % of the polymer. The alkoxylated side chains of the water soluble polymers may comprise from about 10 to about 55 AO units, or from about 20 to about 50 AO units, or from about 25 to 50 AO units. The polymers, preferably water soluble, may be configured as random, block, graft, or other known configurations. Methods for forming alkoxylated acrylic acid polymers are disclosed in U.S. Pat. No. 3,880,765.

Other suitable organic polymer for use herein includes polyaspartic acid (PAS) derivatives as described in WO 2009/095645 A1.

Enzyme

Enzyme Related Terminology

Nomenclature for Amino Acid Modifications

In describing enzyme variants herein, the following nomenclature is used for ease of reference:

Original amino acid(s):position(s):substituted amino acid(s).

According to this nomenclature, for instance the substitution of glutamic acid for glycine in position 195 is shown as G195E. A deletion of glycine in the same position is shown as G195*, and insertion of an additional amino acid residue such as lysine is shown as G195GK. Where a specific enzyme contains a "deletion" in comparison with other enzyme and an insertion is made in such a position this is indicated as *36D for insertion of an aspartic acid in position 36. Multiple mutations are separated by pluses, i.e.: S99G+V102N, representing mutations in positions 99 and 102 substituting serine and valine for glycine and asparagine, respectively. Where the amino acid in a position (e.g. 102) may be substituted by another amino acid selected from a group of amino acids, e.g. the group consisting of N and I, this will be indicated by V102N/I.

In all cases, the accepted IUPAC single letter or triple letter amino acid abbreviation is employed.

Protease Amino Acid Numbering

The numbering used herein is numbering versus the so-called BPN' numbering scheme which is commonly used in the art and is illustrated for example in WO00/37627.

Amino Acid Identity

The relatedness between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

The degree of identity between an amino acid sequence of and enzyme used herein ("invention sequence") and a different amino acid sequence ("foreign sequence") is calculated as the number of exact matches in an alignment of the two sequences, divided by the length of the "invention sequence" or the length of the "foreign sequence", whichever is the shortest. The result is expressed in percent identity. An exact match occurs when the "invention sequence" and the "foreign sequence" have identical amino acid residues in the same positions of the overlap. The length of a sequence is the number of amino acid residues in the sequence.

Preferred enzyme for use herein includes a protease. Suitable proteases include metalloproteases and serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936 B1, U.S. Pat. No. 5,679,630, U.S. Pat. No. 4,760,025, U.S. Pat. No. 7,262,042 and WO09/021,867.

(b) trypsin-type or chymotrypsin-type proteases, such as trypsin (e.g., of porcine or bovine origin), including the *Fusarium* protease described in WO 89/06270 and the chymotrypsin proteases derived from *Cellumonas* described in WO 05/052161 and WO 05/052146.

(c) metalloproteases, including those derived from *Bacillus amyloliquefaciens* described in WO 07/044,993A2.

Preferred proteases include those derived from *Bacillus gibsonii* or *Bacillus Lentus.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference:

68, 87, 99, 101, 103, 104, 118, 128, 129, 130, 167, 170, 194, 205 & 222 and optionally one or more insertions in the region comprising amino acids 95-103.

Preferably, the mutations are selected from one or more, preferably two or more and more preferably three or more of the following: V68A, N87S, S99D, S99SD, S99A, S101G, S103A, V104N/I, Y167A, R170S, A194P, V2051 and/or M222S.

Most preferably the protease is selected from the group comprising the below mutations (BPN' numbering system) versus either the PB92 wild-type (SEQ ID NO:2 in WO 08/010,925) or the subtilisin 309 wild-type (sequence as per PB92 backbone, except comprising a natural variation of N87S).

(i) G118V+S128L+P129Q+5130A
(ii) G118V+S128N+P129S+5130A+S166D
(iii) G118V+S128L+P129Q+S130A+S166D
(iv) G118V+S128V+P129E+S130K
(v) G118V+S128V+P129M+S166D
(vi) G118V+S128F+P129L+S130T
(vii) G118V+S128L+P129N+S130V
(viii) G118V+S128F+P129Q
(ix) G118V+S128V+P129E+S130K+S166D
(x) G118V+S128R+P129S+S130P
(xi) S128R+P129Q+S130D
(xii) S128C+P129R+S130D
(xiii) S128C+P129R+S130G
(xiv) S101G+V104N
(xv) N76D+N87S+S103A+V104I
(xvi) V68A+N87S+S101G+V104N
(xvii) S99SD+S99A
(xviii) N87S+S99SD+S99A Suitable commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101 R+S103A+V104I+G159S, hereinafter referred to as BLAP), BLAP R (BLAP with S3T+V4I+V199M+V205I+L217D), BLAP X (BLAP with S3T+V4I+V2051) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao. Preferred for use herein in terms of performance is a dual protease system, in particular a system comprising a protease comprising S99SD+S99A mutations (BPN' numbering system) versus either the PB92 wild-type (SEQ ID NO:2 in WO 08/010,925) or the subtilisin 309 wild-type (sequence as per PB92 backbone, except comprising a natural variation of N87S). and a DSM14391 *Bacillus Gibsonii* enzyme, as described in WO 2009/021867 A2.

Preferred levels of protease in the product of the invention include from about 0.1 to about 10, more preferably from about 0.5 to about 5 and especially from about 1 to about 4 mg of active protease per grams of product.

Preferred enzyme for use herein includes alpha-amylases, including those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334).

Preferred amylases include:

(a) the variants described in WO 94/02597, WO 94/18314, WO96/23874 and WO 97/43424, especially the variants with substitutions in one or more of the following positions versus the enzyme listed as SEQ ID No. 2 in WO 96/23874: 15, 23, 105, 106, 124, 128, 133, 154, 156, 181, 188, 190, 197, 202, 208, 209, 243, 264, 304, 305, 391, 408, and 444.

(b) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:
26, 30, 33, 82, 37, 106, 118, 128, 133, 149, 150, 160, 178, 182, 186, 193, 203, 214, 231, 256, 257, 258, 269, 270, 272, 283, 295, 296, 298, 299, 303, 304, 305, 311, 314, 315, 318, 319, 339, 345, 361, 378, 383, 419, 421, 437, 441, 444, 445, 446, 447, 450, 461, 471, 482, 484, preferably that also contain the deletions of D183* and G184*.

(c) variants exhibiting at least 90% identity with SEQ ID No. 4 in WO06/002643, the wild-type enzyme from *Bacillus* SP722, especially variants with deletions in the 183 and 184 positions and variants described in WO 00/60060, which is incorporated herein by reference.

(d) variants exhibiting at least 95% identity with the wild-type enzyme from *Bacillus* sp. 707 (SEQ ID NO:7 in U.S. Pat. No. 6,093,562), especially those comprising one or more of the following mutations M202, M208, 5255, R172, and/or M261. Preferably said amylase comprises one or more of M202L, M202V, M2025, M202T, M202I, M202Q, M202W, S255N and/or R172Q. Particularly preferred are those comprising the M202L or M202T mutations.

Preferred α-amylases include the below variants of SEQ ID No. 12 in WO 06/002643:

(a) one or more, preferably two or more, more preferably three or more substitutions in the following positions: 9, 26, 149, 182, 186, 202, 257, 295, 299, 323, 339 and 345; and
(b) optionally with one or more, preferably four or more of the substitutions and/or deletions in the following positions: 118, 183, 184, 195, 320 and 458, which if present preferably comprise R118K, D183*, G184*, N195F, R320K and/or R458K.

Preferred amylases include those comprising the following sets of mutations:

(i) M9L+, M323T;
(ii) M9L+M202L/T/V/I+M323T;
(iii) M9L+N195F+M202L/T/V/I+M323T;
(iv) M9L+R118K+D183*+G184*+R320K+M323T+R458K;
(v) M9L+R118K+D183*+G184*+M202L/T/V/I; R320K+M323T+R458K;
(vi) M9L+G149A+G182T+G186A+M202L+T257I+Y295F+N299Y+M323T+A339S+E345R;
(vii) M9L+G149A+G182T+G186A+M202I+T257I+Y295F+N299Y+M323T+A339S+E345R;
(viii) M9L+R118K+G149A+G182T+D183*+G184*+G186A+M202L+T257I+Y295F+N299Y+R320K+M323T+A339S+E345R+R458K;
(ix) M9L+R118K+G149A+G182T+D183*+G184*+G186A+M202I+T257I+Y295F+N299Y+R320K+M323T+A339S+E345R+R458K;

(x) M9L+R118K+D183*+D184*+N195F+M202L+R320K+M323T+R458K;

(xi) M9L+R118K+D183*+D184*+N195F+M202T+R320K+M323T+R458K;

(xii) M9L+R118K+D183*+D184*+N195F+M202I+R320K+M323T+R458K;

(xiii) M9L+R118K+D183*+D184*+N195F+M202V+R320K+M323T+R458K;

(xiv) M9L+R118K+N150H+D183*+D184*+N195F+M202L+V214T+R320K+M323T+R458K; or (xv) M9L+R118K+D183*+D184*+N195F+M202L+V214T+R320K+M323T+E345N+R458K.

(xvi) M9L+R118K+G149A+G182T+D183*+G184*+G186A+N195F+M202L+T257I+Y295F+N299Y+R320K+M323T+A339S+E345R+R458K Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Additional Enzymes

Additional enzymes suitable for use in the product of the invention can comprise one or more enzymes selected from the group comprising hemicellulases, cellulases, cellobiose dehydrogenases, peroxidases, proteases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof.

Cellulases

The product of the invention preferably comprises other enzymes in addition to the protease and/or amylase. Cellulase enzymes are preferred additional enzymes, particularly microbial-derived endoglucanases exhibiting endo-beta-1,4-glucanase activity (E.C. 3.2.1.4), including a bacterial polypeptide endogenous to a member of the genus *Bacillus* which has a sequence of at least 90%, preferably 94%, more preferably 97% and even more preferably 99% identity to the amino acid sequence SEQ ID NO:2 in U.S. Pat. No. 7,141,403B2 and mixtures thereof. Preferred commercially available cellulases for use herein are Celluzyme®, Celluclean®, Whitezyme® (Novozymes A/S) and Puradax HA® and Puradax® (Genencor International).

Preferably, the product of the invention comprises at least 0.01 mg of active amylase per gram of composition, preferably from about 0.05 to about 10, more preferably from about 0.1 to about 6, especially from about 0.2 to about 4 mg of amylase per gram of composition.

Preferably, the protease and/or amylase of the product of the invention are in the form of granulates, the granulates comprise less than 29% of efflorescent material by weight of the granulate or the efflorescent material and the active enzyme (protease and/or amylase) are in a weight ratio of less than 4:1.

Drying Aids

Preferred drying aids for use herein include polyesters, especially anionic polyesters formed from monomers of terephthalic acid, 5-sulphoisophthalic acid, alkyl diols or polyalkylene glycols, and, polyalkyleneglycol monoalkylethers. Suitable polyesters to use as drying aids are disclosed in WO 2008/110816. Other suitable drying aids include specific polycarbonate-, polyurethane- and/or polyurea-polyorganosiloxane compounds or precursor compounds thereof of the reactive cyclic carbonate and urea type, as described in WO 2008/119834.

Improved drying can also be achieved by a process involving the delivery of surfactant and an anionic polymer as proposed in WO 2009/033830 or by combining a specific non-ionic surfactant in combination with a sulfonated polymer as proposed in WO 2009/033972.

Preferably the composition of the invention comprises from 0.1% to 10%, more preferably from 0.5 to 5% and especially from 1% to 4% by weight of the composition of a drying aid.

Silicates

Preferred silicates are sodium silicates such as sodium disilicate, sodium metasilicate and crystalline phyllosilicates. Silicates if present are at a level of from about 1 to about 20%, preferably from about 5 to about 15% by weight of composition.

Bleach

Inorganic and organic bleaches are suitable cleaning actives for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated.

Alkali metal percarbonates, particularly sodium percarbonate are preferred perhydrates for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids including diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and Nphthaloylaminoperoxicaproic acid are also suitable herein.

Further typical organic bleaches include the peroxy acids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 10 carbon atoms, in particular from 2 to 4 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). Bleach activators if included in the compositions of the invention are in a level of from about 0.1 to about 10%, preferably from about 0.5 to about 2% by weight of the total composition.

Bleach Catalyst

Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410). A complete description of bleach catalysts suitable for use herein can be found in WO 99/06521, pages 34, line 26 to page 40, line 16. Bleach catalyst if included in the compositions of the invention are in a level of from about 0.1 to about 10%, preferably from about 0.5 to about 2% by weight of the total composition.

Metal Care Agents

Metal care agents may prevent or reduce the tarnishing, corrosion or oxidation of metals, including aluminium, stainless steel and non-ferrous metals, such as silver and copper. Preferably the composition of the invention comprises from 0.1 to 5%, more preferably from 0.2 to 4% and specially from 0.3 to 3% by weight of the composition of a metal care agent, preferably the metal care agent is a zinc salt.

Example

Particles according to the invention are made according to the following process. 1000 g of Trilon M liquid (MGDA tri-sodium salt, approximately 40% active, supplied by BASF) is mixed with 91.7 g of concentrated (98%) sulphuric acid to achieve a pH approximately 6. Subsequently, 60 g of sodium sulphate are added in the form of saturated solution at 25° C. Water is then added in a 50:50 weight ratio to give a final mixture. This mixture is then heated to 60° C. with agitation and spray dried in an APB lab scale spray drier at a rate of 7.5 l/hour through two fluid nozzles using atomized air at 2 bars. The inlet drying air is at a temperature between 265°-300° C. The air outlet temperature is between 70°-80° C.

The resulting powder is then compacted to form a tablet in a 1.25 inch circular dye using a total force of 10 tons. The resulting tablet is then ground in a coffee grounder and sieved between 250 μm and 1700 μm to give the final particles. The particles exhibit high resistance to moisture and have good flowability and solubility.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to the term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A particle comprising an aminocarboxylic builder and sulphate or citrate wherein the aminocarboxylic builder and the sulphate or citrate are present in a weight ratio of from about 6:1 to about 1:1, and wherein the particle comprises at least about 40% of aminocarboxylic builder by weight thereof.

2. The particle according to claim 1 wherein the aminocarboxylic builder is methylglycine diacetic acid or a salt thereof.

3. The particle according to claim 1 wherein the particle has a pH in 1% wt aqueous solution at 20° C. of less than about 10.

4. The particle according to claim 1 having a bulk density of greater than about 650 g/l.

5. The particle according to claim 1 having a weight geometric mean particle size of from about 400 μm to about 1200 μm with less than 10% by weight of the particle above about 1400 μm and less than 10% by weight of the particle below about 400 μm.

6. A process for making the particle of claim 1 comprising the steps of:

a) providing a solution containing an aminocarboxylic builder;

b) optionally adding an acidifying agent;

c) adding sulphate or citrate to the solution resulting from of step b) to form a mixture; and d) converting the mixture resulting from step c) into particles.

7. An automatic dishwashing detergent composition comprising the particle according to claim 1.

* * * * *